United States Patent [19]

Gross et al.

[11] Patent Number: 4,793,010

[45] Date of Patent: Dec. 27, 1988

[54] BABY ROCKER APPARATUS

[75] Inventors: Joseph Gross, Moshav Mazor; David Lowenstein, Nethanya; Menachem Tilman, Hofit; Etan Rosenberg, Rimon, all of Israel

[73] Assignee: General Ideas & Products Ltd., Tel Aviv, Israel

[21] Appl. No.: 113,304

[22] Filed: Oct. 28, 1987

[51] Int. Cl.[4] ..... A47D 9/02

[52] U.S. Cl. ..... 5/109; 5/105; 5/508

[58] Field of Search ..... 5/109, 108, 101, 105, 5/106, 93 R, 508

[56] References Cited

U.S. PATENT DOCUMENTS

| | | | |
|---|---|---|---|
| 2,529,721 | 11/1950 | Baruch | 5/109 |
| 3,225,365 | 12/1965 | Miller et al . | 5/109 |
| 3,378,859 | 4/1968 | Parker | 5/109 |
| 3,802,003 | 4/1974 | Laureti | 5/109 X |
| 3,952,343 | 4/1976 | Wong | 5/109 |
| 3,992,731 | 11/1976 | Carswell | 5/109 |
| 4,258,446 | 3/1981 | McAllister et al. | 5/109 |
| 4,419,777 | 12/1983 | Parker | 5/109 X |
| 4,490,867 | 1/1985 | Gabrielsson | 5/109 X |
| 4,590,631 | 5/1986 | Varney | 5/109 X |

*Primary Examiner*—Ramon O. Ramirez

*Attorney, Agent, or Firm*—Benjamin J. Barish

[57] ABSTRACT

Apparatus for rocking a baby holding device having four legs supporting same on the floor, comprises a roller for supporting each leg so as to be rollable over the floor, and a rocker device including a base adapted to be non-rotatably supported on the floor, a holder rollably supported on the base and adapted to receive its respective leg of the baby holding device, and an electrical motor for rocking the holder with respect to said base. The rocker device further includes a tape recorder for playing music or the like during the operation of the rocking device.

20 Claims, 3 Drawing Sheets

FIG 4
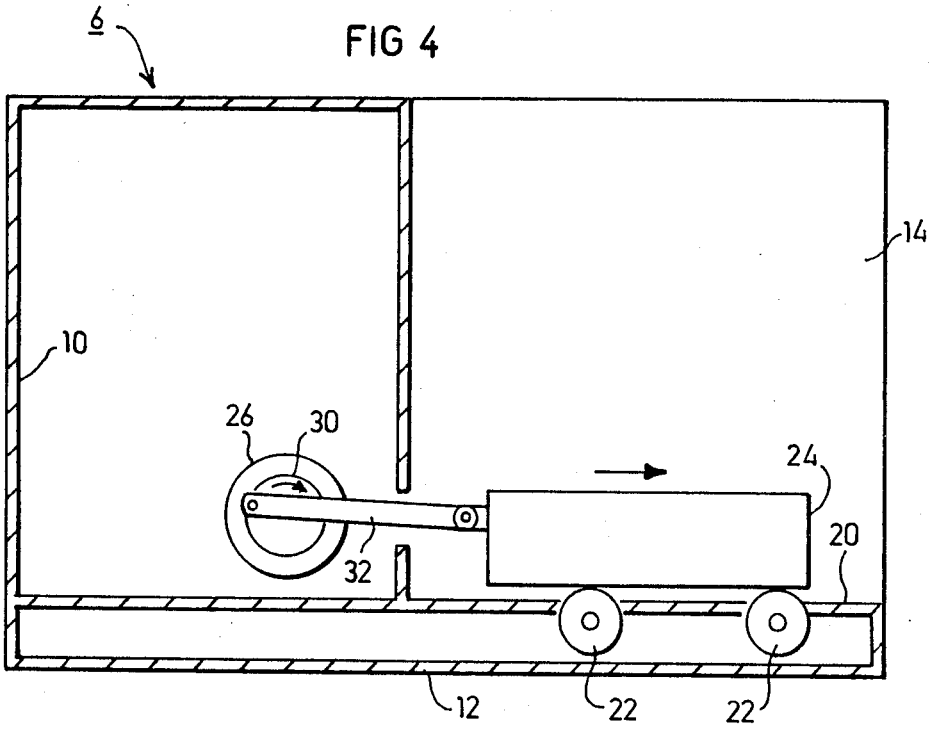
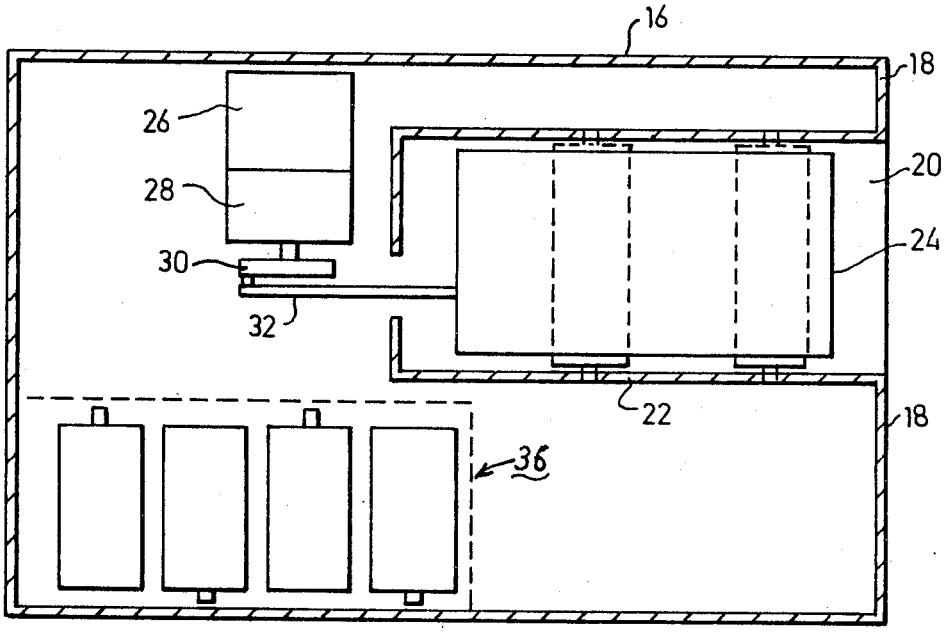
FIG 5

BABY ROCKER APPARATUS

BACKGROUND OF THE INVENTION

The present invention relates to baby rocker apparatus, and particularly to apparatus for rocking a baby holding device, such as a bed, crib, play-pen or cradle.

A large number of baby rocker arrangements have been proposed for rocking a baby holding device in order to quiet down the baby or to promote sleep. Many of the known devices, however, involve a special construction of the baby's bed to incorporate the rocker device. Other known constructions require relatively complicated constructions of rocker devices, or relatively complicated attachments to be made to the baby holding device in order to couple it to the rocker device.

An object of the present invention is to provide novel apparatus which may be used in a quick and convenient manner to convert substantially any conventional baby holding device, such as a baby's bed, crib, play-pen or cradle, into a rocker for rocking the baby.

BRIEF SUMMARY OF THE INVENTION

According to the present invention, there is provided apparatus for rocking a baby holding device having a plurality of legs for supporting the device on the floor, comprising: roller means for each of the legs for supporting the respective leg so as to be rollable over the floor; one of the roller means comprising a base separate from, and detached from, the roller means of all the remaining legs and adapted to be non-rotatably supported on the floor to underline one of said legs, a holder rollably supported on the base and adapted to receive its respective leg of the baby holding device, and a motor for rocking and the leg received in its socket the holder with respect to the base.

According to another important feature in the described preferred embodiment, the rocker device further comprises a housing mounted to the base and enclosing the motor, and a sound reproducer within the housing for reproducing pre-recorded sounds during the rocking of the baby holding device. In this described embodiment, the housing further includes a timer for controlling the time of operation of the electrical motor to rock the baby holding device, a microphone, and a control circuit to actuate the electrical motor to rock the baby holding device automatically in response to the baby crying for a predetermined interval of time, and a manual button for manually actuating the electrical motor to rock the baby holding device.

In the described preferred embodiment, the sound reproducer is a cassette-tape recorder for receiving a cassette tape on which are recorded the sounds to be reproduced, a Play button for playing the cassette tape, a Record button for recording on the cassette tape, and an Eject button for ejecting the cassette tape.

As will be more particularly described below, the rocking apparatus constructed in accordance with the foregoing features may be applied in a very quick an simple manner to the legs of any conventional baby holding device to convert it to a baby rocker. In addition, the apparatus may be either manually actuated, or automatically actuated in response to the baby crying for a predetermined interval of time. During the rocking operation, recorded sounds, such as soft music or the mother's voice, may be played to pacify the baby or to induce the baby to sleep.

Further features and advantages of the invention will be apparent from the description below.

BRIEF DESCRIPTION OF THE DRAWINGS

The invention is herein described, by way of example only, with reference to the accompanying drawings, wherein:

FIGS. 4 and 5 are vertical and horizontal sectional views, respectively, illustrating the construction of the rocker device of FIG. 2;

DESCRIPTION OF A PREFERRED EMBODIMENT

Figure 1:
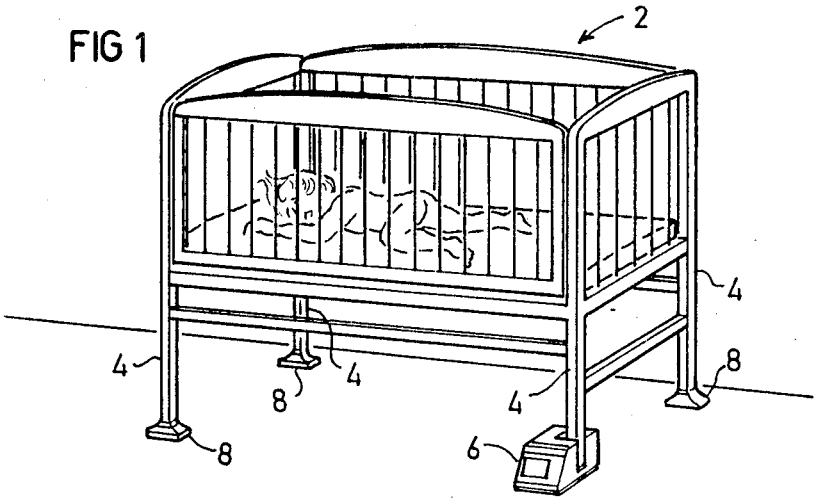
FIG. 1 illustrates one form of apparatus constructed in accordance with the present invention as applied to a baby bed for converting same to a baby rocker.

FIG. 1 illustrates a baby holding device, in the form of a baby bed generally designated 2, of conventional construction and including four legs 4 for supporting the bed on the floor. One of the legs is received in a rocker device, generally designated 6, which includes an electrical motor and rollers for reciprocating the bed 2 in order to impart a rocking motion to it. The other three legs 4 receive roller devices, generally designated 8 (more particularly illustrated in FIG. 3) to permit the bed to be reciprocated back and forth when rocked by the rocker device 6.

Figure 2:
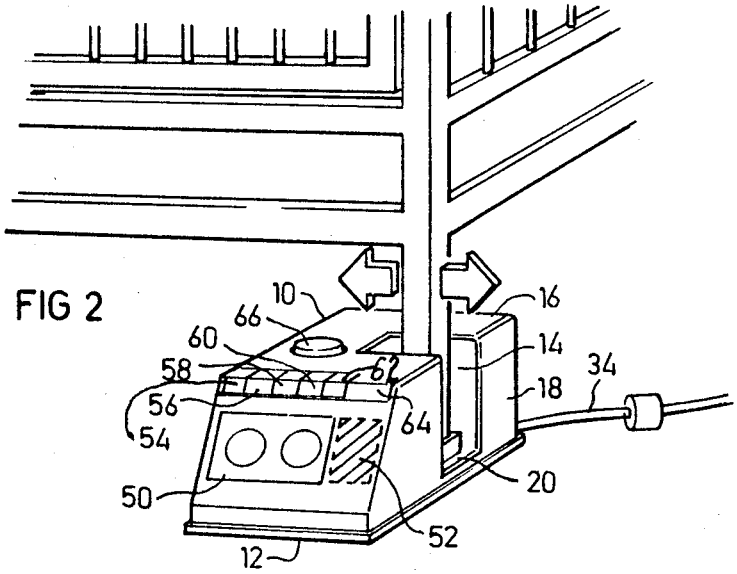
FIG. 2 illustrates the rocker device applied to one of the legs of the baby bed in FIG. 1.

Rocker device 6, as shown more particularly in FIGS. 2, 4 and 5, comprises a housing 10 having a relatively large base 12 adapted to be supported on the floor in a non-slippable manner. For example, the underface of base 12 could be formed of a high-friction elastomeric material, such as natural or synthetic rubber, or could include a pressure-sensitive adhesive coating.

Housing 10 is formed with a recess or slot 14 extending through its top wall 16 and one of its side walls 18. Slot 14 terminates in a ledge 20 spaced slightly above the housing base 12 as shown particularly in FIG. 4. A pair of rollers 22 are rotatably mounted in the space between base 12 and ledge 20 and project slightly through openings formed in the ledge. These projecting portions of rollers 22 support a holder 24 in a manner permitting the holder to be rollable back and forth within slot 14. Holder 24 serves as a socket for receiving the respective leg of bed 2 such that tee reciprocation of holder 24 on rollers 22 also reciprocates the respective leg 4 of the bed with respect to the floor, and thereby reciprocates the bed on roller devices 8 of the other three legs 4.

Housing 10 further includes a drive unit comprising an electrical motor 26 and step-down gearing 28 for rotating a drive disc 30. The latter disc is eccentrically coupled by a crank arm 32 to holder 24 so as to reciprocate the holder through a forward stroke and a return stroke during each rotation of disc 30. Motor 26 may be energized by the supply mains via electrical cord 34 (FIG. 2), or by batteries 36 (FIG. 5) contained within housing 10.

Figure 3:
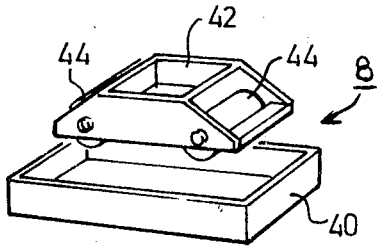
FIG. 3 illustrates one of the roller devices applied to the other three legs of the baby bed.

The structure of the roller devices 8 received by the other three legs 4 of the bed 2 is seen in FIG. 3. Each device 8 also includes a base 40 having a non-slip surface with respect to the floor, and a holder 42 serving as a socket to receive the respective leg 4 of the bed and to support it for movement within the base 40. In this case, however, holder 42 is movable with respect to its base 40 by a pair of rollers 44 carried by the holder 42 rather than by the base as in the rocker device 6.

It will thus be seen that when one leg 4 of the bed 2 is received within holder 24 of rocker device 6, and the other three legs 4 are received within holders 42 of the other three roller devices 8, the energization of motor 26 in the rocker device will cause the bed to reciprocate back and forth within slot 14 of the rocker device. Motor 26 is operated so as to produce a rocking rate of 30–60 reciprocations per minute, with each reciprocation involving a displacement of about 1–5 cm, e.g., 3 cm, in each direction. Such a rocking rate and displacement has been found particularly effective to pacify a crying baby or to promote sleep.

Figure 6:
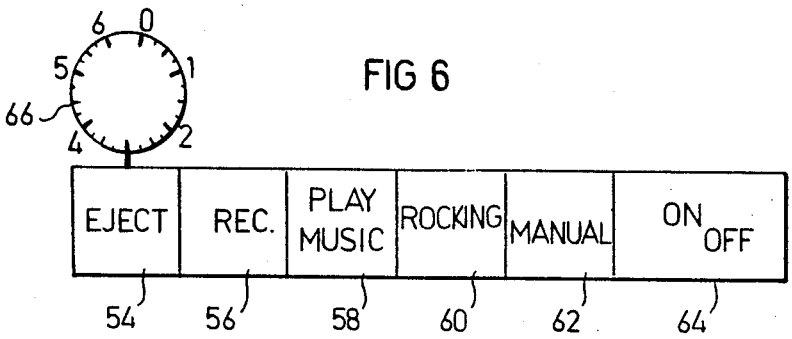
FIG. 6 illustrates the control panel in the rocker device of FIG. 2.

It has also been found that baby pacification and sleep-promotion can be further enchanced by playing soft sounds, e.g., music or the mother's voice, with the rocking movements Rocker device 6 therefore includes a receiver for receiving a cassette-tape 50 which may include recordings of sounds to be reproduced, and a speaker 52 for reproducing the sounds. As shown in FIG. 6, the rocker device 6 includes a control panel comprising an Eject button 54, a Record button 56, and a Play-Music button 58, for performing cassette-ejection, recording and play-back functions, respectively, as in a conventional cassette-type tape recorder and play-back unit.

Figure 7:
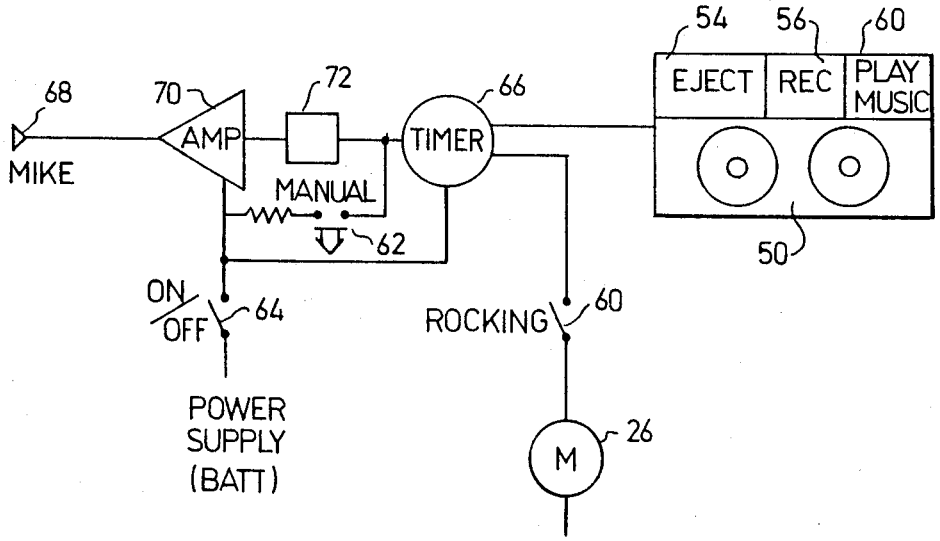
FIG. 7 a block diagram illustrating the overall operation of the rocker device of FIG. 2.

As further shown in FIG. 6, the control panel of the rocker device 6 further includes a Rocking button 60, a Manual button 62, an On/Off button 64, and a presettable timer 66 which presets the time of operation of electric motor 26 of the rocker device 6 when the motor has been actuated. Motor 26 may be actuated automatically in response to the baby crying for a predetermined time period. For this purpose, the electrical circuit of the rocker device 6 includes, as shown in FIG. 7, a microphone 68 for picking-up the baby sounds, an amplifier 70 for amplifying them, and a control circuit 72 which actuates motor 26, via timer 66, whenever the baby has been crying for a predetermined time interval as determined by circuit 72. Circuit 72 may be one of the cry-responsive circuits known in other rocker devices, effective to automatically actuate the rocker motor 26, via timer 66, when the baby has been crying above a predetermined intensity for a predetermined period of time. Manual button 62 is connected parallel to the control circuit 72 (FIG. 7) so as to actuate motor 26, also via timer 66, whenever the button is depressed by the user.

The manner of using the rocker apparatus illustrated in the drawings will be apparent from the above description. Thus, one leg 4 of the baby bed 2 is first received within holder 24 of rocker device 6, and the other three legs 4 are received within holders 42 of their respective roller devices 8. The On/Off button 64 is then actuated to its On position, Rocking button 60 is depressed, and timer 66 is preset to fix the time interval (in minutes) for operation of the motor 26 of rocker device 6 once the motor has been actuated.

Motor 26 of the rocker device 6 may be actuated in one of two ways: Thus, it will be automatically actuated when the baby cries at a predetermined intensity for a predetermined time interval, the baby cries being picked-up by microphone 68, amplified in amplifier 70, and monitored by control unit 72. Alternatively, motor 26 may also be actuated by merely depressing Manual button 62. Either actuation of motor 26 starts timer 66 running such that, upon the expiration of the predetermined time interval as preset in the timer, the motor will be automatically deenergized to terminate the rocking movements.

Timer 66 also controls the tape-recorder and reproducer unit so as to reproduce the sounds recorded on the cassette-tape 50 during the rocking of the baby bed. For example, the recorded sounds may be soft music or the mother's voice pre-recorded on the cassette tape using the Record button 56, as in a conventional cassette-type tape recorder.

If, upon termination of the rocking movements, the baby is still crying, or starts again to cry, the cries will again be picked up by microphone 68 and will again actuate motor 26 to start a new cycle of operation for a new time interval as preset in timer 66.

If it is desired only to play back the recording on the cassette tape, without rocking the bed, Rocking button 60 would not be depressed so that its switch will be open, thereby preventing the actuation of the rocking motor 26; in this case, the foregoing-controls including the timer 66 would control only the tape recorder.

It will thus be seen that the illustrated apparatus provides small, portable units which can be easily applied in order to convert almost any baby bed, or other type of baby holding device such as a play-pen, crib or cradle, to a baby rocker.

While the invention has been described with respect to one preferred embodiment, it will be appreciated that many other variations, modifications and applications of the invention may be made.

What is claimed is:

1. Apparatus for rocking a baby holding device having a plurality of legs for supporting the device on the floor, comprising: roller means for each of said legs for supporting the respective leg so as to be rollable over the floor; one of said roller means comprising a base separate from, and detached from, the roller means of all the remaining legs and adapted to be non-rotatable supported on the floor to underlie one of said legs; a holder rollably supported on the base and adapted to receive its respective leg of the baby holding device; and a motor for rocking said holder and the leg received in its socket with respect to said base.

2. The apparatus according to claim 1, wherein each of the roller means, other than said one roller means, also includes a base adapted to be non-rotatably supported on the floor, and a holder rollably supported on its base and adapted to receive its respective leg of the baby holding device.

3. The apparatus according to claim 1, wherein said one roller means further comprises a housing mounted to said base and enclosing said motor, and a sound reproducer within said housing for reproducing prerecorded sounds during the rocking of the baby holding device.

4. The apparatus according to claim 3, wherein said holder is supported within a slot formed in said housing for receiving the respective leg of the baby holding device.

5. The apparatus according to claim 4, wherein said base underlying said slot and holder includes a plurality of rollers rotatably mounted thereto for rollably receiving said holder.

6. The apparatus according to claim 3, wherein said housing further includes a timer for controlling the time of operation of the motor to rock the baby holding device.

7. The apparatus according to claim 3, wherein said housing further includes a microphone, and a control circuit to actuate said motor to rock the baby holding device automatically in response to the baby crying for a predetermined period of time.

8. The apparatus according to claim 7, wherein said housing further includes a manual button for manually actuating said motor to rock the baby holding device.

9. The apparatus according to claim 3, wherein said housing further includes a cassette-tape receiver for receiving a cassette tape on which are recorded the sounds to be reproduced, a Play button for playing the cassette tape, a Record button for recording on the cassette tape, and an Eject button for ejecting the cassette tape.

10. The apparatus according to claim 1, wherein said motor is connected to said holder to reciprocate it at a rate of 30–60 reciprocations per minute, with each reciprocation involving a displacement of 1–5 cm in each direction.

11. Apparatus for rocking a baby holding device having four legs supporting same on the floor comprising:

roller means for three of said legs for supporting the respective leg so as to be rollable over the floor;

a rocker device for the fourth leg separate from, and detached from, the roller means of all the remaining legs and comprising a base adapted to be non-rotatably supported on the floor to underlie one of said legs, a holder rollably supported on said base and adapted to receive its respective leg of the baby holding device, and a motor for rocking said holder and the leg received in its socket with respect to said base;

each of said roller means also including a base adapted to be non-rotatably supported on the floor, and a holder rollably supported on its base and adapted to receive its respective leg of the baby holding device.

12. The apparatus according to claim 11, wherein in said rocker device, the holder is rollably supported on rollers rotatably mounted to said base; and in said each of said roller means, the holder is rollably supported on rollers rotatably mounted to the respective holder.

13. The apparatus according to claim 11, wherein said rocker device further comprises a housing mounted to said base and enclosing said motor, and a sound reproducer within said housing for reproducing pre-recorded sounds during the rocking of the baby holding device.

14. The apparatus according to claim 13, wherein said holder is supported within a slot formed in said housing for receiving the respective leg of the baby holding device.

15. The apparatus according to claim 13, wherein said housing further includes a timer for controlling the time of operation of the motor to rock the baby holding device.

16. The apparatus according to claim 13, wherein said housing further includes a microphone, and a control circuit to actuate said motor to rock the baby holding device automatically in response to the baby crying for a predetermined period of time.

17. The apparatus according to claim 16, wherein said housing further includes a manual button for manually actuating said motor to rock the baby holding device.

18. The apparatus according to claim 13, wherein said housing further includes a cassette-tape receiver for receiving a cassette tape on which are recorded the sounds to be reproduced, a Play button for playing the cassette tape, a Record button for recording on the cassette tape, and an Eject button for ejecting the cassette tape.

19. Apparatus for rocking a baby holding device having a plurality of legs for supporting the device on the floor comprising: roller means mounted on each of said legs for supporting the respective leg so as to be rollable over the floor; a housing to underlie one of said legs, which housing is separate from, and detached from, the roller means mounted on all the remaining legs and is adapted to be non-rotatably supported on the floor; a holder movably received on said housing for reciprocatory movements with respect to its and having a socket to receive said one leg of the baby holding device; an electrical motor within said housing for reciprocating said holder; a timer within said housing for presetting the time of operation of said electrical motor once it has been actuated; and a tape-recorder within said housing for playing-back the sounds recorded on a tape during the reciprocation of the holder during the operation of the electrical motor.

20. The apparatus according to claim 19, wherein said holder is rollably supported on a ledge at the bottom of a slot formed in said rocker device for receiving said one leg of the baby holding device.

* * * * *